US007412368B2

(12) United States Patent
Mitchell

(10) Patent No.: US 7,412,368 B2
(45) Date of Patent: Aug. 12, 2008

(54) METHODS AND COMPUTER-READABLE MEDIA FOR DETERMINING DESIGN PARAMETERS TO PREVENT TUBING BUCKLING IN DEVIATED WELLBORES

(75) Inventor: Robert F. Mitchell, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 11/274,637

(22) Filed: Nov. 15, 2005

(65) Prior Publication Data

US 2006/0106588 A1 May 18, 2006

Related U.S. Application Data

(60) Provisional application No. 60/723,513, filed on Oct. 4, 2005, provisional application No. 60/628,032, filed on Nov. 15, 2004.

(51) Int. Cl.
*G06F 7/60* (2006.01)
*G06G 7/48* (2006.01)
*E21B 17/02* (2006.01)

(52) U.S. Cl. ..... 703/10; 703/2; 464/18

(58) Field of Classification Search ..... 166/242, 166/285, 381; 294/2; 285/288.1; 703/1–2, 703/10; 175/61; 464/18
See application file for complete search history.

(56) References Cited

U.S. PATENT DOCUMENTS 6,286,595 B1 * 9/2001 Oxnevad et al. ..... 166/242.7
6,526,819 B2 * 3/2003 Demarchos et al. ..... 73/152.01
6,684,952 B2 * 2/2004 Brockman et al. ..... 166/250.03
2004/0221985 A1 * 11/2004 Hill et al. ..... 166/250.01

OTHER PUBLICATIONS

Mitchell, R. F., Exact Analytic Solutions for Pipe Buckling in Vertical and Horizontal Wells, Society of Petroleum Engineers, Apr. 2001.*
Qiu, Weiyoung, Force Transmission of Coiled Tubing in Horizontal Wells, Society of Petroleum Engineers, 1999.*
Cunha, J. C., Buckling of Tubulars Inside Wellbores: A Revire on Recent Theoretical and Experimental Works, Mar. 2003.*
He, Xiaojun et al., Helical Buckling and Lock-Up Conditions for Coiled Tubing in Curved Wells, Society of Petroleum Engineers, Feb. 1995.*
Dawson, Rapier, Drillpipe Buckling in Inclined Holes, Society of Petroleum Engineers, 1984.*
Mitchell, R. F., Tubing Buckling-The Rest of the Story, Society of Petroleum Engineers, Oct. 2005.*

* cited by examiner

*Primary Examiner*—Hugh Jones
(74) *Attorney, Agent, or Firm*—Merchant & Gould, P.C.

(57) ABSTRACT

Methods and computer-readable media are provided for determining design parameters for oil well casing and tubing to prevent buckling in deviated wellbores. Well parameter data including tubing size, tubing weight, well depth, and well geometry is obtained and may be utilized to calculate parameters for predicting the movement of tubing near a packer or centralizer in the deviated wellbore based on the received well parameter data, predicting a total bending moment near the packer or centralizer, predicting a maximum bending stress near the packer or centralizer based on the total bending moment, and predicting the minimum axial force necessary to initiate buckling due to friction, and predicting the onset of buckling for the connection of tubing of different sizes. After the parameters have been calculated, they may be utilized in the design of the oil well casing and tubing to prevent buckling in the deviated wellbore.

18 Claims, 5 Drawing Sheets

METHODS AND COMPUTER-READABLE MEDIA FOR DETERMINING DESIGN PARAMETERS TO PREVENT TUBING BUCKLING IN DEVIATED WELLBORES

CROSS-REFERENCE TO RELATED APPLICATIONS

This patent application claims priority to U.S. Provisional Patent Application Ser. No. 60/628,032, entitled "NOVEL ANALYSIS FOR CASING AND TUBING BUCKLING," filed on Nov. 15, 2004 and U.S. Provisional Patent Application Ser. No. 60/723,513, entitled "METHODS FOR THE STRESS ANALYSIS AND DESIGN OF TUBING AND CASING STRINGS IN A WELLBORE," filed on Oct. 4, 2005. Both of the aforementioned patent applications are assigned to the same assignee as this application and are expressly incorporated herein by reference.

TECHNICAL FIELD

The present invention is related to the analysis of oil well casing and pipe or tubing buckling caused by critical loading in a wellbore. More particularly, the present invention is related to the accurate determination of critical loading parameters in the design of oil well tubing to prevent buckling in deviated wellbores.

BACKGROUND

In an oil well, casing is typically installed to withstand various pressures which may be present in an open hole or wellbore and to stabilize the pipes or tubing used for drilling. Typically, casing hangs straight down in vertical wells or lies on the low side of the hole in deviated wells. During drilling operations, thermal or pressure loads within a wellbore may produce compressive loads which, if sufficiently high, will cause the initial well configuration to become unstable. However, since the tubing is confined within the casing (or alternatively an open hole), the tubing can deform into another stable configuration, which may be a helical or coil shape in a vertical well or a lateral "S" shaped configuration in a deviated well. The change to the new configurations caused by the deformed tubing is known as "buckling."

In tubing and casing design, the accurate analysis of buckling is important for several reasons. First, buckling generates bending stresses not present in the original configuration. If the stresses in the original (i.e., "unbuckled") configuration were near yield, additional stress could produce failure in the tubing, including permanent plastic deformation called "corkscrewing." Second, buckling causes movement in oil well tubing. That is, buckled tubing (which is coiled) is shorter than straight tubing, and this is an important consideration if the tubing is not fixed. Third, tubing buckling causes the relief of compressive axial loads when the casing surrounding the tubing is fixed.

Previously, models have been developed for analyzing buckling in wells, however, these models suffer from several drawbacks when applied to deviated wells. One drawback with previous models is that tubing bending stress due to buckling will be overestimated for deviated wells. Another drawback with previous models as applied to deviated wells is that they over predict tubing movement. Still another drawback with previous models is that tubing compliance is overestimated, which may greatly underestimate the axial loads able to be withstood by the surrounding casing. It is with respect to these considerations and others that the various embodiments of the present invention have been made.

SUMMARY

Illustrative embodiments of the present invention address these issues and others by providing a method of determining design parameters for oil well casing and tubing to prevent buckling in a deviated wellbore. According to the method, well parameter data is received which may include tubing size, tubing weight, well depth, and well geometry. The method further includes calculating a first parameter for predicting the movement of tubing near at least one boundary condition in the deviated wellbore based on the received well parameter data. The boundary condition may be a packer installed in the deviated wellbore, a centralizer installed in the deviated wellbore, or both.

The method further includes calculating a second parameter for predicting a total bending moment near the at least one boundary condition, calculating a third parameter for predicting a maximum bending stress near the at least one boundary condition in the deviated wellbore based on the total bending moment, and calculating a fourth parameter for predicting the minimum axial force necessary to initiate buckling due to friction, based on the received well parameter data. The method may further include calculating a fifth parameter for predicting the onset of buckling for the connection of tubing of different sizes (i.e., tapered strings) based on the received well parameter data. After the first, second, third, fourth, and fifth parameters have been calculated, they may be utilized in the design of the oil well casing and tubing to prevent buckling in the deviated wellbore.

Other illustrative embodiments of the invention may also be implemented in a computer system or as an article of manufacture such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process.

These and various other features, as well as advantages, which characterize the present invention, will be apparent from a reading of the following detailed description and a review of the associated drawings.

DETAILED DESCRIPTION

Figure 1:
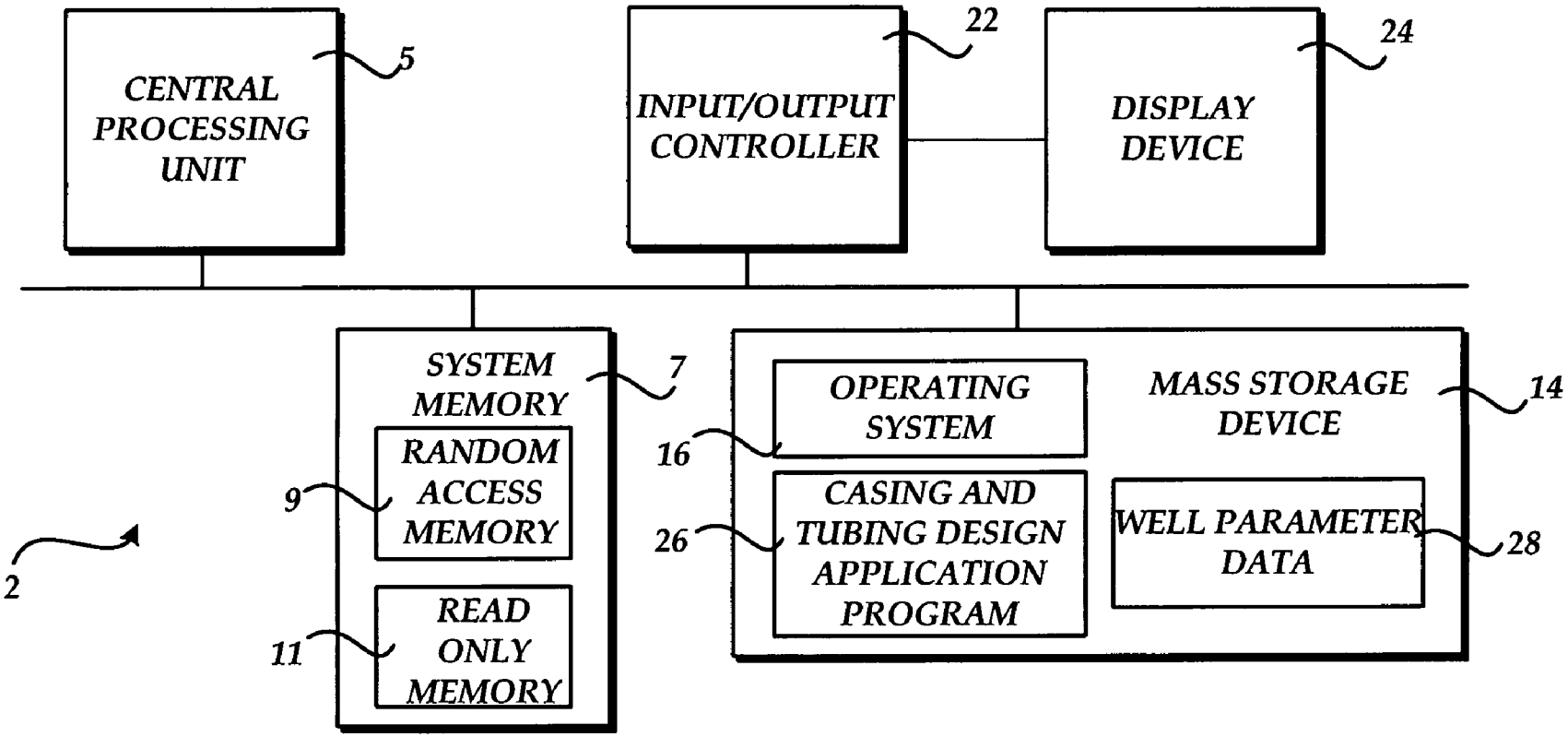
FIG. 1 shows a typical computer system operating environment for illustrative embodiments of the present invention.
Figure 2:
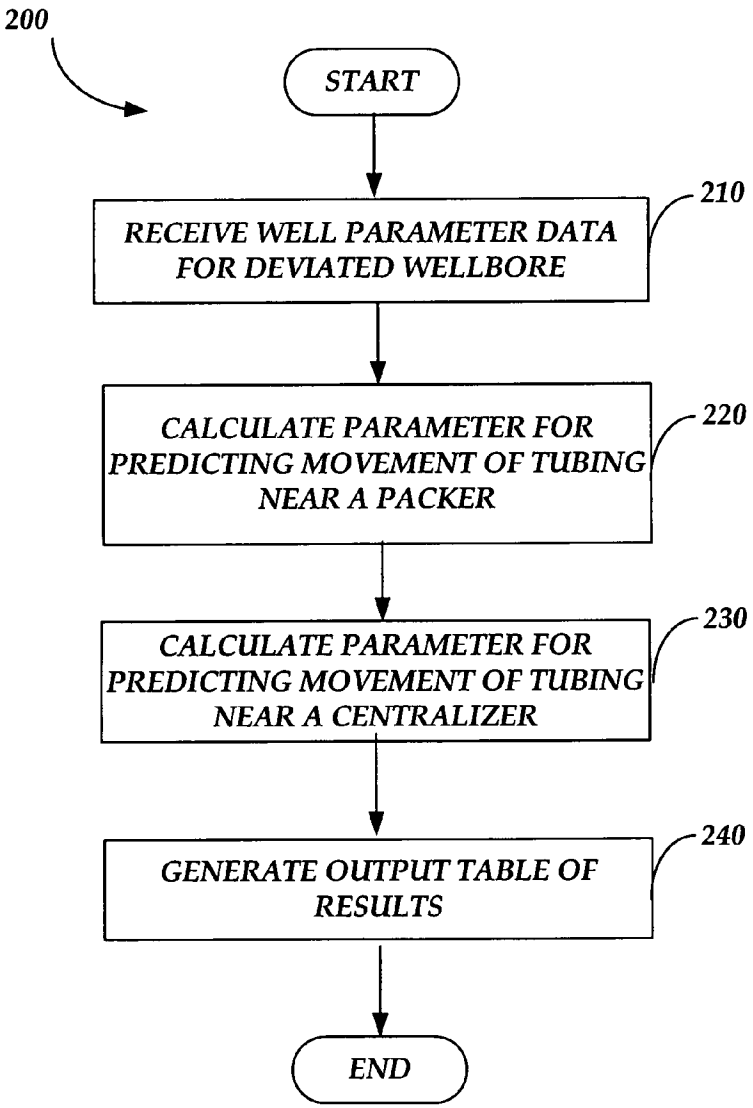
FIG. 2 shows logical operations performed by an illustrative embodiment for calculating a parameter for predicting the movement of tubing near at least one boundary condition in a deviated wellbore.

Illustrative embodiments of the present invention provide for determining design parameters for oil well casing and tubing to prevent buckling in a deviated wellbore. Referring now to the drawings, in which like numerals represent like elements, various aspects of the present invention will be described. In particular, FIG. 1 and the corresponding discussion are intended to provide a brief, general description of a suitable computing environment in which embodiments of the invention may be implemented. While the invention will be described in the general context of program modules that execute in conjunction with program modules that run on an operating system on a personal computer, those skilled in the art will recognize that the invention may also be implemented in combination with other types of computer systems and program modules.

Generally, program modules include routines, programs, components, data structures, and other types of structures that perform particular tasks or implement particular abstract data types. Moreover, those skilled in the art will appreciate that the invention may be practiced with other computer system configurations, including hand-held devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote memory storage devices.

Referring now to FIG. 1, an illustrative computer architecture for a computer 2 utilized in the various embodiments of the invention will be described. The computer architecture shown in FIG. 1 illustrates a conventional desktop or laptop computer, including a central processing unit 5 ("CPU"), a system memory 7, including a random access memory 9 ("RAM") and a read-only memory ("ROM") 11, and a system bus 12 that couples the memory to the CPU 5. A basic input/output system containing the basic routines that help to transfer information between elements within the computer, such as during startup, is stored in the ROM 11. The computer 2 further includes a mass storage device 14 for storing an operating system 16, application programs 26, and seismic data 28, which will be described in greater detail below.

The mass storage device 14 is connected to the CPU 5 through a mass storage controller (not shown) connected to the bus 12. The mass storage device 14 and its associated computer readable media provide non-volatile storage for the computer 2. Although the description of computer readable media contained herein refers to a mass storage device, such as a hard disk or CD-ROM drive, it should be appreciated by those skilled in the art that computer readable media can be any available media that can be accessed by the computer 2.

By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, RAM, ROM, EPROM, EEPROM, flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer 2.

The computer 2 may also include an input/output controller 22 for receiving and processing input from a number of other devices, including a keyboard, mouse, or electronic stylus (not shown in FIG. 1). Similarly, an input/output controller 22 may provide output to display screen 24, a printer, or other type of output device.

As mentioned briefly above, a number of program modules and data files may be stored in the mass storage device 14 and RAM 9 of the computer 2, including an operating system 16 suitable for controlling the operation of a personal computer. The computer 2 is also capable of executing one or more application programs. In particular, the computer 2 is operative to execute casing and tubing design application program 26. According to the various illustrative embodiments of the invention, the casing and tubing design application program 26 (hereinafter referred to as "the application program 26") comprises program modules for performing various "buckling" calculations used in the design of oil well casing and tubing. The data files stored in the mass storage device 14 may include well parameter data 28. The well parameter data 28 may include, but is not limited to, well tubing size (e.g., the inside and outside dimensions of the well tubing), tubing weight, well depth, well geometry (e.g., whether a well is vertical, horizontal, or otherwise deviated), radial clearance (i.e., the maximum distance tubing may move from the center of the wellbore or casing until it touches the wall of the wellbore or casing that it is confined by), the moment of inertia for the tubing, the temperature of the tubing in a wellbore, the current pressure in the wellbore, and whether the wellbore contains a packer or centralizer. As is known to those skilled in the art, packers are devices for holding tubing in a wellbore when the tubing is run from the surface. Packers provide a pressure seal for the wellbore and prevent fluids from mixing down hole. Centralizers are mechanical devices (i.e., collars) which are used to position casing concentrically in a wellbore and prevent the casing from lying eccentrically against the wellbore wall.

As will be described in greater detail below, the well parameter data is utilized by the application program 26 to perform buckling calculations for designing oil well casing and tubing. According to one embodiment of the invention, the application program 26 may comprise the WELLCAT application program marketed by LANDMARK GRAPHICS CORPORATION of Houston, Tex. It should be appreciated, however, that the various aspects of the invention described herein may be utilized with other application programs from other manufacturers. Additional details regarding the various calculations performed by the application program 26 will be provided below with respect to FIGS. 2-5.

Referring now to FIGS. 2-5, illustrative logical operations or routines will be described illustrating a process for determining design parameters for oil well casing and tubing to prevent buckling in a deviated wellbore. When reading the discussion of the illustrative routines presented herein, it should be appreciated that the logical operations of various embodiments of the present invention are implemented (1) as a sequence of computer implemented acts or program modules running on a computing system and/or (2) as interconnected machine logic circuits or circuit modules within the computing system. The implementation is a matter of choice dependent on the performance requirements of the computing system implementing the invention. Accordingly, the logical operations illustrated in FIGS. 2-5, and making up illustrative embodiments of the present invention described herein are referred to variously as operations, structural devices, acts or modules. It will be recognized by one skilled in the art that these operations, structural devices, acts and modules may be implemented in software, in firmware, in special purpose digital logic, and any combination thereof without deviating from the spirit and scope of the present invention as recited within the claims attached hereto.

In the following discussion of FIGS. 2-5, a number of formulae utilized by the application program 26 to calculate parameters for predicting various buckling conditions will be described using the following nomenclature:

E=Young's modulus, psi
F=axial buckling force
P=buckling force, lbf
G=pipe shear modulus
$\wp$=the pitch of a helix, L, ft.
I=moment of inertia of tubing, $L^4$, $in^4$
J=polar moment of inertia of tubing, $L^4$, $in^4$
EI=the bending stiffness of tubing
M=total bending moment, ft-lbf.
$M_i$=bending moment in i direction, ft-lbf.
$r_c$=tubing-casing radial clearance, L, in.
$r_p$=tubing-casing radius, L, in.
$d_o$=tubing outside diameter, L, in.
s=measured depth, L, ft.
$w_c$=contact load between a wellbore and tubing
$w_{bp}$=the buoyant weight of the tubing
$n_z$=the vertical component of the normal to the wellbore trajectory
$b_z$=the vertical component to the binormal to the wellbore trajectory
κ=wellbore curvature
T=term in contact force equation, dimensionless
$u_1$, $u_2$=tubing displacements, L, in.
$w_n$=the contact load between the tubing and casing, lbf/ft.
α=coefficient in solutions, $L^{-1}$, $ft^{-1}$
β=coefficient in solutions, $L^{-1}$, $ft^{-1}$
δ, μ=parameters in beam-column equations (μ is also the dynamic coefficient of friction in buckling criterion with friction equations)
$\Delta s_0$, $\Delta s_1$=beam-column solution lengths, L, ft.
ϵ, $\epsilon_0$, $\epsilon_1$=slopes in beam-column solutions, dimensionless
θ=angle between the pipe center location and an x coordinate
$\theta_1$=angle in beam-column solution, radians
ξ=dimensionless length=αs
subscript o indicates initial conditions Referring now to FIG. 2, an illustrative routine 200 performed by a processing device, such as the CPU 5 of the computer of FIG. 1 will be described for calculating a parameter for predicting the movement of tubing near at least one boundary condition in a deviated wellbore, according to one embodiment of the invention. As defined herein and in the appended claims, a "boundary condition" may comprise either a packer or a centralizer installed in a deviated wellbore. The routine 200 begins at operation 210 where the application program 26 receives the well parameter data 28 by retrieving it from the mass storage device 14. As discussed above with respect to FIG. 1, the well parameter data 28 may include a number of measurements including well tubing size (e.g., the inside and outside dimensions of the well tubing), tubing weight, well depth, well geometry (e.g., whether a well is vertical, horizontal, or otherwise deviated), radial clearance (i.e., the maximum distance tubing may move from the center of the wellbore or casing until it touches the wall of the wellbore or casing that it is confined by), the moment of inertia for the tubing, the temperature of the tubing in a wellbore, the current pressure in the wellbore, and whether the wellbore contains a packer or centralizer. It will be appreciated that the well parameter data 28 may also be manually inputted directly into the application program 26 by a user.

The routine 200 then continues from operation 210 at operation 220 where the application program 26 calculates a parameter for predicting the movement (i.e., displacement) of tubing near a packer in the deviated wellbore when the tubing starts to buckle. In particular, the application program 26 calculates a "beam-column" solution. As is known to those skilled in the art, a beam-column is a structural member that is subjected to simultaneous axial and transverse loads (i.e., compression and bending). For the packer boundary condition, the application program 26 performs an analysis to calculate a beam-column solution to buckling equations which brings the tubing from a centralized position, tangent to the wellbore, to a point tangent to the wellbore wall. The application program 26 utilizes the following equations to satisfy these conditions:

$$u_{1b}=[\sin\xi_o(\xi-\sin\xi)+(1-\cos\xi_o)(\cos\xi-1)]/\delta$$

$$u_{2b}=\epsilon[(1-\cos\xi_o)(\sin\xi-\xi)+(\sin\xi_o-\xi_o)(\cos\xi-1)]/\delta$$

$$\delta=\xi_o\sin\xi_o-2(1-\cos\xi_o)$$

$$\xi=s\sqrt{\frac{P}{EI}}$$

where ϵ is given by:

$$\varepsilon=\sqrt{\frac{\cos\xi_o-1}{\delta}}$$

and $\xi_o$ is approximately 3.84333.

The application program 26 then calculates a solution dθ/dξ for the above equations which is:

$$\frac{d\theta}{d\xi}=\frac{\sqrt{2}}{2}\tanh\left(\frac{\sqrt{2}}{2}\Delta\xi+\phi_s\right)$$

where: ϕs~1.01108. It will be appreciated that the above solution equation may be integrated to give theta:

$$\theta(\xi)=\ln\left[\frac{\cosh\left(\frac{\sqrt{2}}{2}\Delta\xi+\phi_s\right)}{\cosh(\phi_s)}\right]$$

The routine 200 then continues from operation 220 at operation 230 where the application program 26 calculates a parameter for predicting the movement (i.e., displacement) of tubing near a centralizer in the deviated wellbore when the tubing starts to buckle. For the centralizer boundary condition, the application program 26 performs an analysis to calculate a beam-column solution to buckling equations which brings the tubing from a centralized position, free to rotate, to a point tangent to the wellbore wall. The application program 26 utilizes the following equations to satisfy these conditions:

$$u_{1b}=[(\xi-\sin\xi)+(\cos\xi_o-1)\xi]/\mu$$

$$u_{2b}=\epsilon[\xi_o(\sin\xi-\xi)+(\xi_o-\sin\xi_o)\xi]/\mu$$

$$\mu=\xi_o\cos\xi_o-\sin\xi_o$$

$$\xi=s\sqrt{\frac{P}{EI}}$$

where $\epsilon$ is given by:

$$\varepsilon=\sqrt{\frac{-\sin\xi_o}{\mu}}$$

and $\xi_o$ is approximately 2.505309.

The application program 26 calculates a solution $d\theta/d\xi$ for the above equations which is:

$$\frac{d\theta}{d\xi}=\frac{\sqrt{2}}{2}\tanh\left(\frac{\sqrt{2}}{2}\Delta\xi+\phi_c\right)$$

where $\phi_c$~81965. It will be appreciated that the above solution equation may be integrated to give theta:

$$\theta(\xi)=\ln\left[\frac{\cosh\left(\frac{\sqrt{2}}{2}\Delta\xi+\phi_c\right)}{\cosh(\phi_c)}\right]$$

It will be appreciated by those skilled in the art that the buckling calculations discussed above apply to "near" boundary conditions in a wellbore, contrary to previous buckling models which only applied to "far away" from the boundary conditions.

The routine 200 then continues from operation 230 at operation 240 where the application program 26 generates an output table of the results of the calculations performed in operations 220 and 230. In particular, the results may comprise a table of solutions corresponding to various sizes and weights of tubing, well depths, and axial forces at various well depths. The routine 200 then ends.

Figure 3:
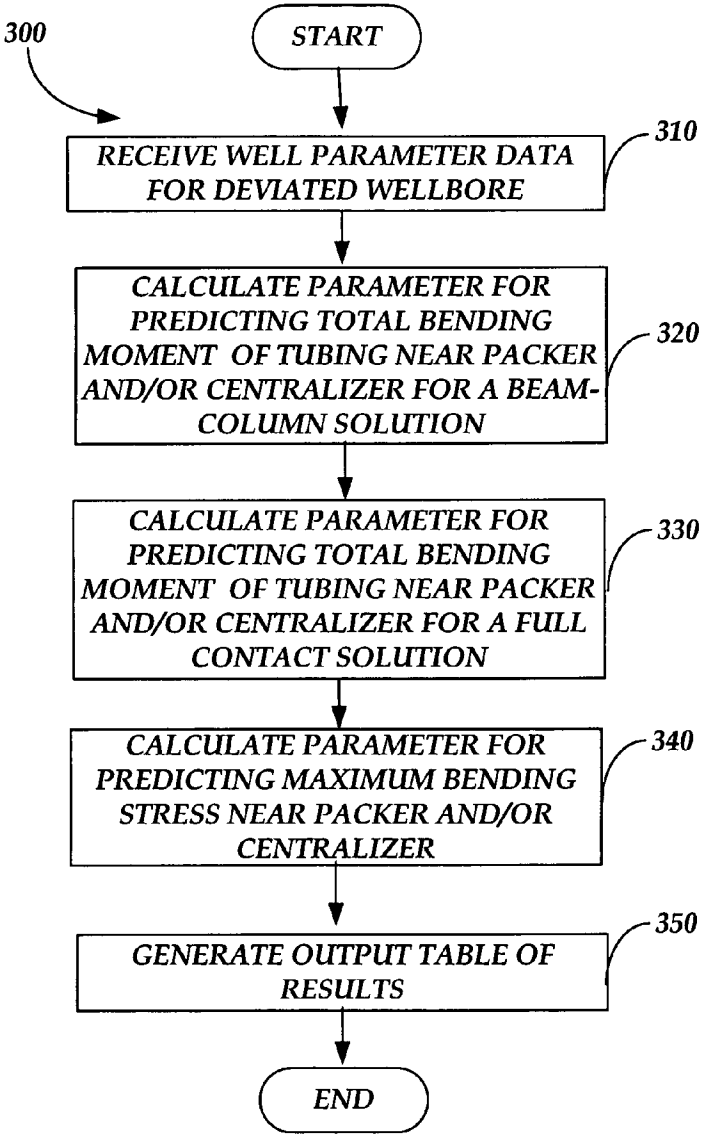
FIG. 3 shows logical operations performed by an illustrative embodiment for calculating parameters for predicting total bending moments and maximum bending stresses near at least one boundary condition in a deviated wellbore.

Referring now to FIG. 3, an illustrative routine 300 performed by a processing device, such as the CPU 5 of the computer of FIG. 1 will be described for calculating a parameter for predicting total bending moments and maximum bending stresses near a boundary condition in a deviated wellbore, according to one embodiment of the invention. The routine 300 begins at operation 310 where the application program 26 receives the well parameter data 28.

The routine 300 then continues from operation 310 at operation 320 where the application program 26 calculates a parameter for predicting the total bending moment of tubing near a packer and/or centralizer for a beam-column solution by utilizing the following equations:

The bending stresses in the tubing are given by:

$$M_i=EIr\frac{d^2u_i}{ds^2}=Fr\frac{d^2u_i}{d\xi^2}\quad i=1,2$$

The total bending moment is therefore calculated as:

$$M=Fr\sqrt{\left(\frac{d^2u_1}{d\xi^2}\right)^2+\left(\frac{d^2u_2}{d\xi^2}\right)^2}$$

It should be understood that in the above equations, r is the radial clearance of the tubing in the packer or centralizer and $u_1$ and $u_2$ are measures of the lateral displacement of the tubing in the deviated wellbore.

The routine 300 then continues from operation 320 at operation 330 where the application program 26 calculates a parameter for predicting the total bending moment of tubing near a packer and/or centralizer for a full contact solution (i.e., tubing in contact with the wellbore wall) by utilizing the following equation:

$$M=Fr\sqrt{\left(\frac{d\theta}{d\xi}\right)^4+\left(\frac{d^2\theta}{d^2\xi}\right)^2}$$

The routine 300 then continues from operation 330 at operation 340 where the application program 26 calculates a parameter for predicting the maximum bending stress for tubing near a packer and/or centralizer by utilizing the following equation:

$$\sigma_b=\frac{Md_o}{2I}$$

It will be appreciated by those skilled in the art that, contrary to previous buckling models, the beam-column bending moment may exceed the full contact bending moment in both the packer and the centralizer.

The routine 300 then continues from operation 340 at operation 350 where the application program 26 generates an output table of the results of the calculations performed in operations 320 through 340. In particular, the results may comprise a table of solutions corresponding to various sizes and weights of tubing, well depths, and axial forces at various well depths. The routine 300 then ends.

Figure 4:
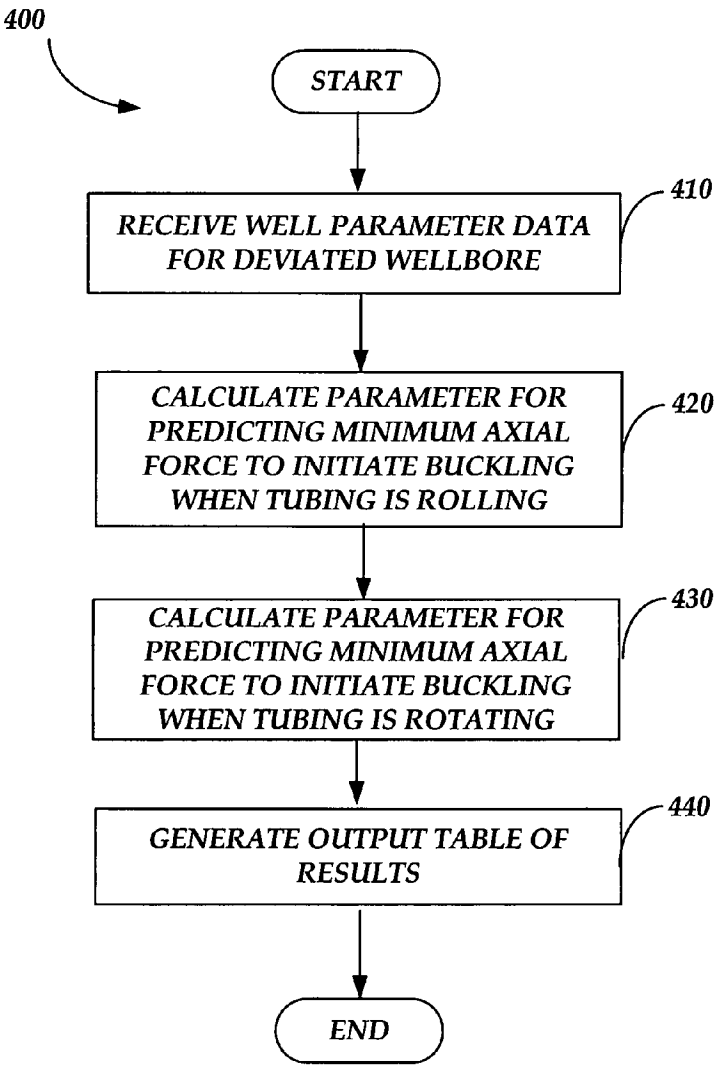
FIG. 4 shows logical operations performed by an illustrative embodiment for calculating parameters for predicting minimum axial forces necessary to initiate buckling due to friction in a deviated wellbore.

Referring now to FIG. 4, an illustrative routine 400 performed by a processing device, such as the CPU 5 of the computer of FIG. 1 will be described for shows logical operations performed by an illustrative embodiment for calculating parameters for predicting minimum axial forces necessary to initiate buckling due to friction in a deviated wellbore. The routine 400 begins at operation 410 where the application program 26 receives the well parameter data 28.

The routine 400 then continues from operation 410 at operation 420 where the application program 26 calculates a parameter for predicting the minimum axial force to initiate buckling when tubing is rolling in a deviated well. In particular, cylindrical tubing lying on the bottom of a deviated well may be subject to rolling friction. The friction gradually produces a lateral force and a moment that is proportional to the lateral displacement of the tubing. In order to account for rolling friction, the application program 26 calculates a critical buckling parameter F representing the minimum axial force necessary to allow buckling using the equation:

$$F = \frac{GJ}{r_p^2} + \sqrt{\frac{4EIw_c}{r_c}}$$

where $w_c$ is given by the equation:

$$w_c = \sqrt{(w_{bp}n_z - F\kappa)^2 + (w_{bp}b_z)^2}$$

It should be understood that in cases where the tubing is laying on a flat plane, such as a seabed, the minimum axial force equation reduces to:

$$F = \frac{GJ}{r_p^2}$$

The routine 400 then continues from operation 420 at operation 430 where the application program 26 calculates a parameter for predicting the minimum axial force to initiate buckling when tubing is rotating in a deviated well. In particular, when tubing is rotating the friction force is constant in the lateral direction relative to the tubing. In order to account for friction caused by rotation, the application program calculates the minimum axial force using the equation:

$$F = \sqrt{\frac{4EIw_c}{r_c}}$$

where the contact load $w_c$ is given by the equation:

$$w_c = \sqrt{\frac{(w_{bp}n_z - F\kappa)^2 + (w_{bp}b_z)^2}{1 + \mu^2}}$$

The routine 400 then continues from operation 430 at operation 440 where the application program 26 generates an output table of the results of the calculations performed in operations 420 and 430. In particular, the results may comprise a table of solutions corresponding to various sizes and weights of tubing. The routine 400 then ends.

Figure 5:
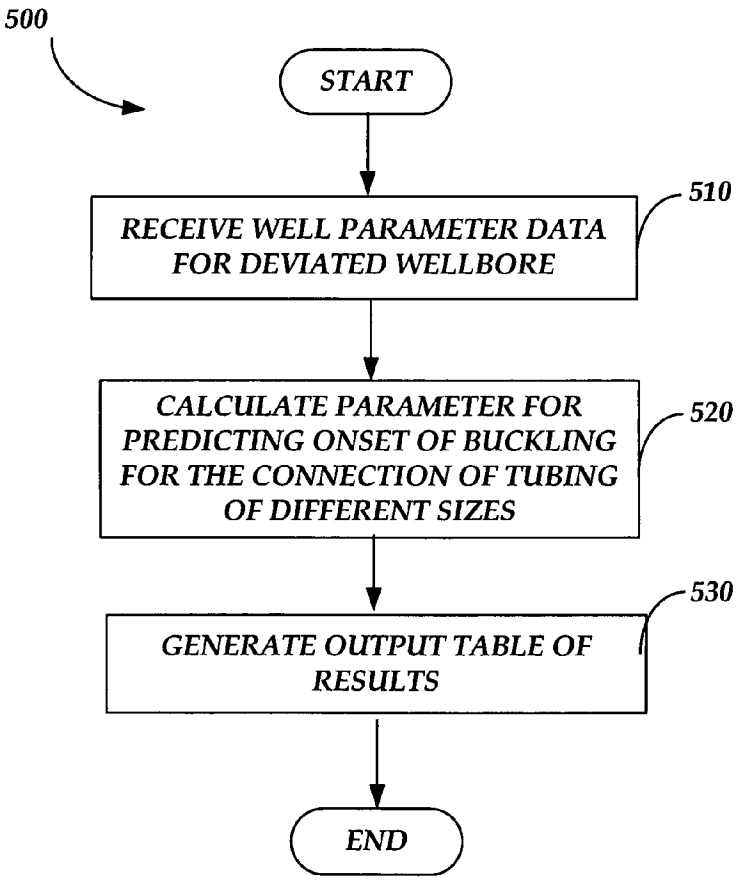
FIG. 5 shows logical operations performed by an illustrative embodiment for calculating a parameter for predicting the onset of buckling for the connection of tubing of different sizes in a deviated wellbore.

Referring now to FIG. 5, an illustrative routine 500 performed by a processing device, such as the CPU 5 of the computer of FIG. 1 will be described for shows logical operations performed by an illustrative embodiment for calculating a parameter for predicting the onset of buckling for the connection of tubing of different sizes (i.e., tapered strings) in a deviated wellbore. The routine 500 begins at operation 410 where the application program 26 receives the well parameter data 28.

The routine 500 then continues from operation 510 at operation 520 where the application program 26 calculates a parameter for predicting the onset of buckling for tapered strings by utilizing the following equations:

$$v_1(s) = r_i - \frac{1}{2\pi}(r_j \pm r_i)[\alpha_b s - \sin(\alpha_b s)]$$

$$v_2(s) = \frac{r_i \theta_i''}{\alpha_i^2}[1 - \cos(\alpha_b s)]$$

$$\alpha_b = \sqrt{\frac{F}{E_b I_b}} \quad s \in \left(0, \frac{2\pi}{\alpha_b}\right)$$

Where the subscript b refers to the properties of the beam-column. The "±" term means that the beam-column solution can move either to the θ=0 (+solution) or to the θ=π(−solution). This means that the beam column solution can create either a right hand or left hand helix, depending on which way the solution moves. Assuming that the $i^{th}$ solution satisfies the above equations, the application program 26 further utilizes the following equations:

$$\theta_i(s) = -\ln\left[\operatorname{sech}\left(\frac{\sqrt{2}}{2}\alpha_i s\right)\right]$$

$$\frac{d\theta_i}{ds} = \frac{\sqrt{2}}{2}\alpha_i \tanh\left(\frac{\sqrt{2}}{2}\alpha_i s\right)$$

$$\alpha_i = \sqrt{\frac{P}{E_i I_i}}$$

Finally, the application program calculates a solution to the following differential equation for tubing in contact with the wellbore wall, provided $r_i$ is less than $r_j$:

$$\frac{d\theta(s)}{ds} = \pm \frac{\sqrt{2}\,\alpha_j r_i sd\left(\lambda s - \frac{2\pi}{\alpha_b}\lambda, k\right)}{2r_j\sqrt{1 + \sum + (1 - \sum)sd^2\left(\lambda s - \frac{2\pi}{\alpha_b}\lambda, k\right)}}$$

$$\sum = \sqrt{\frac{r_j^2 - r_i^2}{r_j^2}}, \quad k = \sqrt{\frac{1 - \sum}{1 + \sum}}, \quad \lambda = \frac{\sqrt{2}}{2}\alpha_j\sqrt{1 + \sum}$$

$$\alpha_j = \sqrt{\frac{P}{E_j I_j}}$$

where sd(*,k) is a Jacobi elliptic function with parameter k.

It will be appreciated by those skilled in the art that the above buckling calculations account for tubing with different radial clearances and bending stiffness contrary to previous buckling models which only applied to tubing sections of the same size (i.e., they did not apply to tapered strings).

The routine 500 then continues from operation 520 at operation 530 where the application program 26 generates an output table of the results of the calculations performed in operation 520. In particular, the results may comprise a table of solutions corresponding to various sizes and weights of tubing, well depths, and axial forces at various well depths. The routine 500 then ends.

Based on the foregoing, it should be appreciated that the various embodiments of the invention include methods and computer readable media for determining design parameters for oil well casing and tubing to prevent buckling in deviated wellbores. Although the present invention has been described in connection with various illustrative embodiments, those of ordinary skill in the art will understand that many modifications can be made thereto within the scope of the claims that follow. Accordingly, it is not intended that the scope of the invention in any way be limited by the above description, but instead be determined entirely by reference to the claims that follow.

What is claimed is:

1. A method of determining design parameters for oil well casing and tubing to prevent buckling in a deviated wellbore, comprising:

receiving well parameter data comprising at least one of tubing size, tubing weight, well depth, and well geometry;

calculating a first parameter used in predicting movement of the tubing near at least one boundary condition in the deviated wellbore based on the received well parameter data, wherein calculating a first parameter used in predicting movement of the tubing near at least one boundary condition in the deviated wellbore based on the received well parameter data comprises calculating a parameter used in predicting the movement of the tubing near a packer in the deviated wellbore using the formula:

$$\theta(\xi) = \ln\left[\frac{\cosh\left(\frac{\sqrt{2}}{2}\Delta\xi + \phi_s\right)}{\cosh(\phi_s)}\right]$$

where $\theta(\xi)$ is a buckling parameter for a beam-column solution for tubing located near the packer in the deviated wellbore;

$\Delta\xi$ is the change in dimensionless length associated with the tubing where $\xi$ is given by the relationship:

$$\xi = s\sqrt{\frac{P}{EI}}$$

where s is the measured depth of the tubing;

P is the axial buckling force of the tubing; and

EI is the bending stiffness of the tubing; and $\phi_s$ is a numerical constant;

calculating a second parameter used in predicting a total bending moment near the at least one boundary condition based on the received well parameter data;

calculating a third parameter used in predicting a maximum bending stress near the at least one boundary condition in the deviated wellbore based on the total bending moment; and calculating a fourth parameter used in predicting a minimum axial force necessary to initiate buckling based on the received well parameter data, wherein the first, second, third, and fourth parameters are utilized in a design of the oil well casing and tubing to prevent buckling in the deviated wellbore.

2. The method of claim 1 further comprising:

calculating a fifth parameter used in predicting an onset of buckling for a connection of tubing of different sizes based on the received well parameter data, wherein the fifth parameter is utilized in the design of the oil well casing and tubing to prevent buckling in the deviated wellbore.

3. The method of claim 2, wherein calculating a fifth parameter used in predicting an onset of buckling for a connection of tubing of different sizes based on the received well parameter data comprises using the formula:

$$\frac{d\theta(s)}{ds} = \pm\frac{\sqrt{2}\,\alpha_j r_i sd\left(\lambda s - \frac{2\pi}{\alpha_b}\lambda, k\right)}{2r_j\sqrt{1 + \sum + (1 - \sum)sd^2\left(\lambda s - \frac{2\pi}{\alpha_b}\lambda, k\right)}}$$

where $$\frac{d\theta(s)}{ds}$$

is a buckling parameter for a beam-column solution to predict the onset of buckling for a connection of a first tubing and a second tubing;

$r_i$ is the radial clearance of the first tubing;

$r_j$ is the radial clearance of the second tubing, wherein $r_i < r_j$;

$$\sum = \sqrt{\frac{r_j^2 - r_i^2}{r_j^2}}$$

$$k = \sqrt{\frac{1 - \sum}{1 + \sum}}$$

$$\alpha_j = \sqrt{\frac{P}{E_j I_j}},$$

where P is the buckling force associated with the connection of the first tubing and the second tubing and $E_j I_j$ is the bending stiffness of the second tubing;

$$\lambda = \frac{\sqrt{2}}{2}\alpha_j\sqrt{1 + \Sigma};$$

$$\alpha_b = \sqrt{\frac{F}{E_b I_b}},$$

where the subscript b refers to the properties of the beam-column solution, where F is the axial buckling force associated with the connection of the first tubing and the second tubing, and $E_b I_b$ is the bending stiffness; and $$s \in \left(0, \frac{2\pi}{\alpha_b}\right),$$

where sd(*,k) is a Jacobi elliptic function with parameter k.

4. The method of claim 1, wherein calculating a second parameter used in predicting a total bending moment near at least one boundary condition in the deviated wellbore based on the received well parameter data comprises calculating a parameter used in predicting a total bending moment of the tubing near at least one of a packer and a centralizer in the deviated wellbore using the formula:

$$M = Fr\sqrt{\left(\frac{d^2u_1}{d\xi^2}\right)^2 + \left(\frac{d^2u_2}{d\xi^2}\right)^2}$$

where $\xi$ is a dimensionless length;

M is the total bending moment in a beam-column solution for the packer or centralizer in the deviated wellbore;

F is the bending stiffness of the tubing;

r is the radial clearance of the tubing in the packer or centralizer; and $u_1$ and $u_2$ are measures of the lateral displacement of the tubing in the deviated wellbore.

5. The method of claim 4, wherein calculating a third parameter used in predicting a maximum bending stress near the at least one boundary condition based on the total bending moment comprises calculating a parameter used in predicting a maximum bending stress near the at least one of a packer and a centralizer in the deviated wellbore using the formula:

$$\sigma_b = \frac{Md_o}{2I}$$

where $\sigma_b$ the maximum bending stress;

$d_o$ is the outside diameter of the tubing; and

I is the moment of inertia of the tubing.

6. The method of claim 1, wherein calculating a fourth parameter used in predicting a minimum axial force necessary to initiate buckling when the tubing is constrained by friction forces based on the received well parameter data comprises using the formula:

$$F = \frac{GJ}{r_p^2} + \sqrt{\frac{4EIw_c}{r_c}}$$

where F is the minimum axial force necessary to initiate buckling in the tubing when the tubing is rolling in the deviated wellbore;

G is the shear modulus of the tubing;

J is the polar moment of inertia of the tubing;

$r_p$ is the radius of the tubing;

EI is the bending stiffness of the tubing;

$w_c$ is the contact load between the deviated wellbore and the tubing; and $r_c$ is the radial clearance of the tubing.

7. A computer-readable storage medium having computer-executable instructions, which when executed by a computer cause the computer to perform a method of determining design parameters for oil well casing and tubing to prevent buckling in a deviated wellbore, the method comprising:

receiving well parameter data comprising at least one of tubing size, tubing weight, well depth, and well geometry;

calculating a first parameter used in predicting movement of the tubing near at least one boundary condition in the deviated wellbore based on the received well parameter data, wherein calculating a first parameter used in predicting movement of the tubing near at least one boundary condition in the deviated wellbore based on the received well parameter data comprises calculating a parameter used in predicting the movement of the tubing near a packer in the deviated wellbore using the formula:

$$\theta(\xi) = \ln\left[\frac{\cosh\left(\frac{\sqrt{2}}{2}\Delta\xi + \phi_s\right)}{\cosh(\phi_s)}\right]$$

where $\theta(\xi)$ is a buckling parameter for a beam-column solution for tubing located near the packer in the deviated wellbore;

$\Delta\xi$ is the change in dimensionless length associated with the tubing where $\xi$ is given by the relationship:

$$\xi = s\sqrt{\frac{P}{EI}}$$

where s is the measured depth of the tubing;

P is the axial buckling force of the tubing; and

EI is the bending stiffness of the tubing; and $\phi_s$ is a numerical constant;

calculating a second parameter used in predicting a total bending moment near the at least one boundary condition based on the received well parameter data;

calculating a third parameter used in predicting a maximum bending stress near the at least one boundary condition in the deviated wellbore based on the total bending moment; and calculating a fourth parameter used in predicting a minimum axial force necessary to initiate buckling based on the received well parameter data, wherein the first, second, third, and fourth parameters are utilized in a design of the oil well casing and tubing to prevent buckling in the deviated wellbore.

8. The computer-readable storage medium of claim 7 further comprising:

calculating a fifth parameter used in predicting an onset of buckling for a connection of tubing of different sizes based on the received wherein the fifth parameter is utilized in the design of the oil well casing and tubing to prevent buckling in the deviated wellbore.

9. The computer-readable storage medium of claim 8, wherein calculating a fifth parameter used in predicting an onset of buckling for a connection of tubing of different sizes based on the received well parameter data comprises using the formula:

$$\frac{d\theta(s)}{ds} = \pm\frac{\sqrt{2}\,\alpha_j r_i sd\left(\lambda s - \frac{2\pi}{\alpha_b}\lambda, k\right)}{2r_j\sqrt{1 + \sum + (1 - \sum)sd^2\left(\lambda s - \frac{2\pi}{\alpha_b}\lambda, k\right)}}$$

where $$\frac{d\theta(s)}{ds}$$

is a buckling parameter for a beam-column solution to predict the onset of buckling for a connection of a first tubing and a second tubing;

$r_i$ is the radial clearance of the first tubing;

$r_j$ is the radial clearance of the second tubing, wherein $r_i<r_j$;

$$\sum = \sqrt{\frac{r_j^2 - r_i^2}{r_j^2}}$$

$$k = \sqrt{\frac{1-\sum}{1+\sum}}$$

$$\alpha_j = \sqrt{\frac{P}{E_j I_j}},$$

where P is the buckling force associated with the connection of the first tubing and the second tubing and $E_jE_j$ is the bending stiffness of the second tubing;

$$\lambda = \frac{\sqrt{2}}{2}\alpha_j\sqrt{1+\Sigma};$$

$$\alpha_b = \sqrt{\frac{F}{E_b I_b}},$$

where the subscript b refers to the properties of the beam-column solution, where F is the axial buckling force associated with the connection of the first tubing and the second tubing, and $E_bI_b$ is the bending stiffness; and $$s \in \left(0, \frac{2\pi}{\alpha_b}\right),$$

where sd(*,k) is a Jacobi elliptic function with parameter k.

10. The computer-readable storage medium of claim 7, wherein calculating a second parameter used in predicting a total bending moment near at least one boundary condition in the deviated wellbore based on the received well parameter data comprises calculating a parameter used in predicting a total bending moment of the tubing near at least one of a packer and a centralizer in the deviated wellbore using the formula:

$$M = Fr\sqrt{\left(\frac{d^2u_1}{d\xi^2}\right)^2 + \left(\frac{d^2u_2}{d\xi^2}\right)^2}$$

where ξ is a dimensionless length;

where M is the total bending moment in a beam-column solution for the packer or centralizer in the deviated wellbore;

F is the axial buckling force of the tubing;

r is the radial clearance of the tubing in the packer or centralizer; and $u_1$ and $u_2$ are measures of the lateral displacement of the tubing in the deviated wellbore.

11. The computer-readable storage medium of claim 10, wherein calculating a third parameter used in predicting a maximum bending stress near the at least one boundary condition based on the total bending moment comprises calculating a parameter used in predicting a maximum bending stress near the at least one of a packer and a centralizer in the deviated wellbore using the formula:

$$\sigma_b = \frac{Md_o}{2I}$$

where $\sigma_b$ the maximum bending stress;

$d_o$ is the outside diameter of the tubing; and

I is the moment of inertia of the tubing.

12. The computer-readable storage medium of claim 7, wherein calculating a fourth parameter used in predicting a minimum axial force necessary to initiate buckling when the tubing is constrained by friction forces based on the received well parameter data comprises using the formula:

$$F = \frac{GJ}{r_p^2} + \sqrt{\frac{4EIw_c}{r_c}}$$

where F is the minimum axial force necessary to initiate buckling in the tubing when the tubing is rolling in the deviated wellbore;

G is the shear modulus of the tubing;

J is the polar moment of inertia of the tubing;

$r_p$ is the radius of the tubing;

EI is the bending stiffness of the tubing;

$w_c$ is the contact load between the deviated wellbore and the tubing; and $r_c$ is the radial clearance of the tubing.

13. A method of determining design parameters for oil well casing and tubing to prevent buckling in a deviated wellbore, comprising:

receiving well parameter data comprising at least one of tubing size, tubing weight, well depth, and well geometry;

calculating a first parameter used in predicting movement of the tubing near at least one boundary condition in the deviated wellbore based on the received well parameter data, wherein calculating a first parameter used in predicting movement of the tubing near at least one boundary condition in the deviated wellbore based on the received well parameter data comprises calculating a parameter used in predicting the movement of the tubing near a centralizer in the deviated wellbore using the formula:

$$\theta(\xi) = \ln\left[\frac{\cosh\left(\frac{\sqrt{2}}{2}\Delta\xi + \phi_s\right)}{\cosh(\phi_s)}\right]$$

where θ(ξ) is a buckling parameter for a beam-column solution for tubing located near the centralizer in the deviated wellbore;

Δξ is the change in dimensionless length associated with the tubing where ξ is given by the relationship:

$$\xi = s\sqrt{\frac{P}{EI}}$$

where s is the measured depth of the tubing;

P is the axial buckling force of the tubing;

EI is the bending stiffness of the tubing; and $\phi_c$ is a numerical constant;

calculating a second parameter used in predicting a total bending moment near the at least one boundary condition based on the received well parameter data;

calculating a third parameter used in predicting a maximum bending stress near the at least one boundary condition in the deviated wellbore based on the total bending moment;

calculating a fourth parameter used in predicting a minimum axial force necessary to initiate buckling based on the received well parameter data; and calculating a fifth parameter used in predicting an onset of buckling for the connection of tubing of different sizes based on the received well parameter data, wherein the at least one boundary condition comprises at least one of a centralizer installed in the deviated wellbore to concentrically position the oil well casing and a packer installed in the deviated wellbore to hold the tubing and wherein the first, second, third, fourth parameters, and fifth parameters are utilized in a design of the oil well casing and tubing to prevent buckling in the deviated wellbore.

14. The method of claim 13, wherein calculating a second parameter used in predicting a total bending moment near at least one boundary condition in the deviated wellbore based on the received well parameter data comprises calculating a parameter used in predicting a total bending moment near at least one of a packer and a centralizer in the deviated wellbore using the formula:

$$M = Fr\sqrt{\left(\frac{d\theta}{d\xi}\right)^4 + \left(\frac{d^2\theta}{d^2\xi}\right)^2}$$

where $\xi$ is a dimensionless length;

M is the total bending moment in a full contact solution for the packer or centralizer in the deviated wellbore;

F is the axial buckling force of the tubing;

r is the radial clearance of the tubing in the packer or centralizer; and $\theta$ is the angle between a tubing center location and an x coordinate on a coordinate axis from the tubing center location to a point tangent to the wall of the deviated wellbore, wherein $x=d\theta/d\xi$.

15. The method of claim 13, wherein calculating a fourth parameter used in predicting a minimum axial force necessary to initiate buckling when the tubing is constrained by friction forces based on the received well parameter data comprises using the formula:

$$F = \sqrt{\frac{4EIw_c}{r_c}}$$

where F is the minimum axial force necessary to initiate buckling in the tubing when the tubing is rotating in the deviated wellbore;

EI is the bending stiffness of the tubing;

$r_p$ is the radius of the tubing;

$r_c$ is the radial clearance of the tubing; and $w_c$ is the contact load between the deviated wellbore and the tubing, wherein $w_c$ is given by the relationship:

$$w_c = \sqrt{\frac{(w_{bp}n_z - F\kappa)^2 + (w_{bp}b_z)^2}{1+\mu^2}}$$

where $w_{bp}$ is the buoyant weight of the tubing;

$n_z$ is the vertical component of the normal to the trajectory of the deviated wellbore;

$b_z$ is the vertical component to the binormal to the trajectory of the deviated wellbore;

$\kappa$ is the curvature of the deviated wellbore; and $\mu$ is the dynamic coefficient of friction with respect to the tubing in the deviated wellbore.

16. A computer-readable storage medium having computer-executable instructions, which when executed by a computer cause the computer to perform a method of determining design parameters for oil well casing and tubing to prevent buckling in a deviated wellbore, the method comprising:

receiving well parameter data comprising at least one of tubing size, tubing weight, well depth, and well geometry;

calculating a first parameter used in predicting movement of the tubing near at least one boundary condition in the deviated wellbore based on the received well parameter data, wherein calculating a first parameter used in predicting movement of the tubing near at least one boundary condition in the deviated wellbore based on the received well parameter data comprises calculating a parameter used in predicting the movement of the tubing near a centralizer in the deviated wellbore using the formula:

$$\theta(\xi) = \ln\left[\frac{\cosh\left(\frac{\sqrt{2}}{2}\Delta\xi + \phi_c\right)}{\cosh(\phi_c)}\right]$$

where $\theta(\xi)$ is a buckling parameter for a beam-column solution for tubing located near the centralizer in the deviated wellbore;

$\Delta\xi$ is the change in dimensionless length associated with the tubing where $\xi$ is given by the relationship:

$$\xi = s\sqrt{\frac{P}{EI}}$$

where s is the measured depth of the tubing;

P is the axial buckling force of the tubing; and

EI is the bending stiffness of the tubing; and $\phi_c$ is a numerical constant;

calculating a second parameter used in predicting a total bending moment near the at least one boundary condition based on the received well parameter data;

calculating a third parameter used in predicting a maximum bending stress near the at least one boundary condition in the deviated wellbore based on the total bending moment; and calculating a fourth parameter used in predicting a minimum axial force necessary to initiate buckling based on the received well parameter data, wherein the first, second, third, and fourth parameters are utilized in a design of the oil well casing and tubing to prevent buckling in the deviated wellbore.

17. The computer-readable storage medium of claim 16, wherein calculating a second parameter used in predicting a total bending moment near at least one boundary condition in the deviated wellbore based on the received well parameter data comprises calculating a parameter used in predicting a total bending moment near at least one of a packer and a centralizer in the deviated wellbore using the formula:

$$M = Fr\sqrt{\left(\frac{d\theta}{d\xi}\right)^4 + \left(\frac{d^2\theta}{d^2\xi}\right)^2}$$

where $\xi$ is a dimensionless length;

M is the total bending moment in a full contact solution for the packer or centralizer in the deviated wellbore;

F is the bending stiffness of the tubing;

r is the radial clearance of the tubing in the packer or centralizer; and $\theta$ is the angle between a tubing center location and an x coordinate on a coordinate axis from the tubing center location to a point tangent to the wall of the deviated wellbore, wherein $x=d\theta/d\xi$.

18. The computer-readable storage medium of claim 16, wherein calculating a fourth parameter used in predicting a minimum axial force necessary to initiate buckling when the tubing is constrained by friction forces based on the received well parameter data comprises using the formula:

$$F = \sqrt{\frac{4EIw_c}{r_c}}$$

where F is the minimum axial force necessary to initiate buckling in the tubing when the tubing is rotating in the deviated wellbore;

EI is the bending stiffness of the tubing;

$r_p$ is the radius of the tubing;

$r_c$ is the radial clearance of the tubing; and $w_c$ is the contact load between the deviated wellbore and the tubing, wherein $w_c$ is given by the relationship:

$$w_c = \sqrt{\frac{(w_{bp}n_z - F\kappa)^2 + (w_{bp}b_z)^2}{1+\mu^2}}$$

where $w_{bp}$ is the buoyant weight of the tubing;

$n_z$ is the vertical component of the normal to the trajectory of the deviated wellbore;

$b_z$ is the vertical component to the binormal to the trajectory of the deviated wellbore;

$\kappa$ is the curvature of the deviated wellbore; and $\mu$ is the dynamic coefficient of friction with respect to the tubing in the deviated wellbore.

* * * * *